US005896726A

United States Patent [19]

Kellaway

[11] Patent Number: 5,896,726

[45] Date of Patent: Apr. 27, 1999

[54] BAG SEALING MACHINE

[75] Inventor: David Kellaway, Dereham, Norfolk Island

[73] Assignee: Thurne Engineering Company Limited, Norfolk, United Kingdom

[21] Appl. No.: 08/970,101

[22] Filed: Nov. 13, 1997

[30] Foreign Application Priority Data

Nov. 18, 1996 [GB] United Kingdom ..... 9623926

[51] Int. Cl.[6] ..... B65B 51/08

[52] U.S. Cl. ..... 53/139.1; 53/583

[58] Field of Search ..... 53/137.2, 139.1, 53/586, 583, 439, 530; 156/468

[56] References Cited

U.S. PATENT DOCUMENTS 3,236,716 2/1966 Loveland et al. ..... 156/468

4,621,479 11/1986 Hoyland ..... 53/583 X 4,782,648 11/1988 Van Ottele ..... 53/586 X

*Primary Examiner*—Linda Johnson

*Attorney, Agent, or Firm*—Sughrue, Mion, Zinn, Macpeak & Seas, PLLC

[57] ABSTRACT

Bag tying machine with a pair of pivoted arms (1,2), a pair of leaf springs (3) between the two arms (1,2) to form a first abutment, and a second abutment (5), preferably formed from a pair of rollers. In use, the open neck of a bag is passed between the arms (1,2) and is gathered together by the leaf springs (3). The gathered together neck of the bag is pushed onto an adhesive tape which is wrapped around the neck of the bag as this passes through the second abutment. The downstream ends of the arms (1,2) are urged together by pneumatic cylinders (6). These are advantageously controlled by a variable pressure controller (9).

7 Claims, 3 Drawing Sheets

BAG SEALING MACHINE

BACKGROUND OF THE INVENTION

Our earlier patent specification EP-A-0128687 describes a bag sealing machine for gathering together the neck of a filled bag and then forming an adhesive tape tie around the gathered together neck. Such machines are widely used, particular in the bakery industry. Typically such machines include a pair of arms which are pivoted at one end and urged together at their opposite ends by compression springs. The open end of a filled bag is urged between the pair of pivoted arms and gathered together by a follow-up member travelling faster than the bag along the pivoted arms. As described in EP-A-0128687 the gathered together neck of the bag is compressed against a first abutment formed by a pair of fixed jaws projecting into the space between the pair of arms, then forced between the jaws onto a piece of adhesive tape and then, together with the piece of adhesive tape forced into contact with a second abutment formed by a second pair of jaws which wraps the adhesive tape around the gathered together neck of the bag and onto itself to complete the tie.

Over the years the speed of operation of such bag sealing machines has increased significantly and one problem that can occur is that the neck of the bag can be torn as it is pushed against the first set of jaws. This is obviously unsatisfactory. The likelihood of the neck being torn depends partly on the speed of throughput of the filled bag, partly on the gauge of the plastic used to form the bags and partly on the weight of the contents of the bag. It also appears that the overall shape of the bag may also influence this because recently attempts have been made to use a gusseted bag for loaves of bread to give a more rectangular appearance to the filled bag and, when operating the bag sealers at high speed with such bags has led to unsatisfactory results.

SUMMARY OF THE INVENTION

According to the present invention a bag sealing machine includes a pair of pivoted arms between which the open end of a filled bag to be sealed is introduced, is gathered together against a first abutment provided on the arms, and is subsequently applied to an adhesive tape extending across the pivoted arms so that the tape is wrapped around the gathered together neck by a second abutment provided on the arms; wherein the first abutment is formed by a pair of leaf springs, and the downstream ends of the arms are connected to pneumatic cylinders arranged to urge them together.

The use of a pair of leaf springs for the first abutment means that the bag can be moved past this abutment without having to move both pivoted arms. It is merely the resistance of the leaf springs which has to be overcome by the gathered together neck of the bag and by choosing leaf springs of the appropriate spring rate, this resistance can be lower than the resistance to passage of the gathered together neck of the bag provided by the second abutment. By lowering the resistance to passage of the first abutments this reduces the likelihood of the gathered together neck of the bag being torn. Since the arms are not moved by the bag passing the first abutment, the arms are correctly located to form the adhesive tape tie around the gathered together neck of the bag as the bag reaches the second abutment.

It is believed that in the past when operating at high speed and using two fixed abutments, the arms had not always fully returned to the closed position or were "bouncing" whilst the gathered together neck of the bag passed between the second abutment. Poor tie formation is avoided in accordance with the present invention by providing the first abutment as a pair of leaf springs and by replacing the springs at the downstream end to the pivoted arms by a pair of pneumatic cylinders.

Preferably the machine includes a variable pressure controller located remotely from the pneumatic cylinders to enable the air pressure applied to the pneumatic cylinders to be varied. Preferably the variable pressure controller is arranged to be accessible during the operation of the machine to enable the pressure applied to the pneumatic cylinders to be varied during operation of the machine. Preferably separate variable pressure controls are provided for each of the pneumatic cylinders. Preferably each pneumatic cylinder has connected to it a one way flow restrictor arranged so that air can readily flow into the cylinder but can only flow out of the cylinder at a low bleed rate. Thus, when the free ends of the pivoted arms are urged away from one another, for example by passage of a gathered together neck of a bag past the second abutment, pressure in the cylinders increases to urge the free ends of the arms back towards one another quickly.

The ability to vary the air pressure in the cylinders also means that the pressure applied to the free ends of the pivoted arms can be varied to control the pressure that is applied to the gathered together neck of the bag as the adhesive ties are formed around it. Whilst theoretically this was possible when the free ends of the arms were connected to compression springs, since the compression springs were provided with a variable pre-loading arrangement, in practice this was difficult to achieve. In the past, to adjust the spring pressure, firstly the machine had to be stopped and its covers removed. In practice, therefore, the springs have always been set with a predetermined pre-loading and not adjusted on site.

We have found that by being able to adjust the pressure in the pneumatic cylinders whilst the bag sealing machine is operating, it is possible to provide a very much better control of the sealing pressure applied at the second abutment and so this can be varied for changes in the bags or the material packed inside the bags.

The bag sealing apparatus may include a number of separate variable pressure controllers for each pneumatic cylinder and a selector switch to select between a number of these different pressure controls to apply one of a number of predetermined pressures to the pneumatic cylinders. This enables the machine to be set up for more than one type of bag and allows the operator simply to operate a selector switch depending on the type of bags to be fed through the machine. However, this arrangement is not usually required.

Preferably the second abutment is formed by a pair of rollers mounted on the pivoted arms.

A particular advantage of the present invention is that in the event of a jam occurring, as soon as the machine is opened to enable access to the pivoted arms, for example to remove any jammed gathered together bags, opening the cover typically isolates the machine from power and pneumatic supplies with the result that the arms are no longer urged together and in fact the lower arm typically falls down under gravity to release any jammed bag necks.

BRIEF DESCRIPTION OF THE DRAWINGS

The present invention will be described in accordance with the accompanying drawings, in which.

DETAILED DESCRIPTION OF PREFERRED EMBODIMENTS

Figure 1:
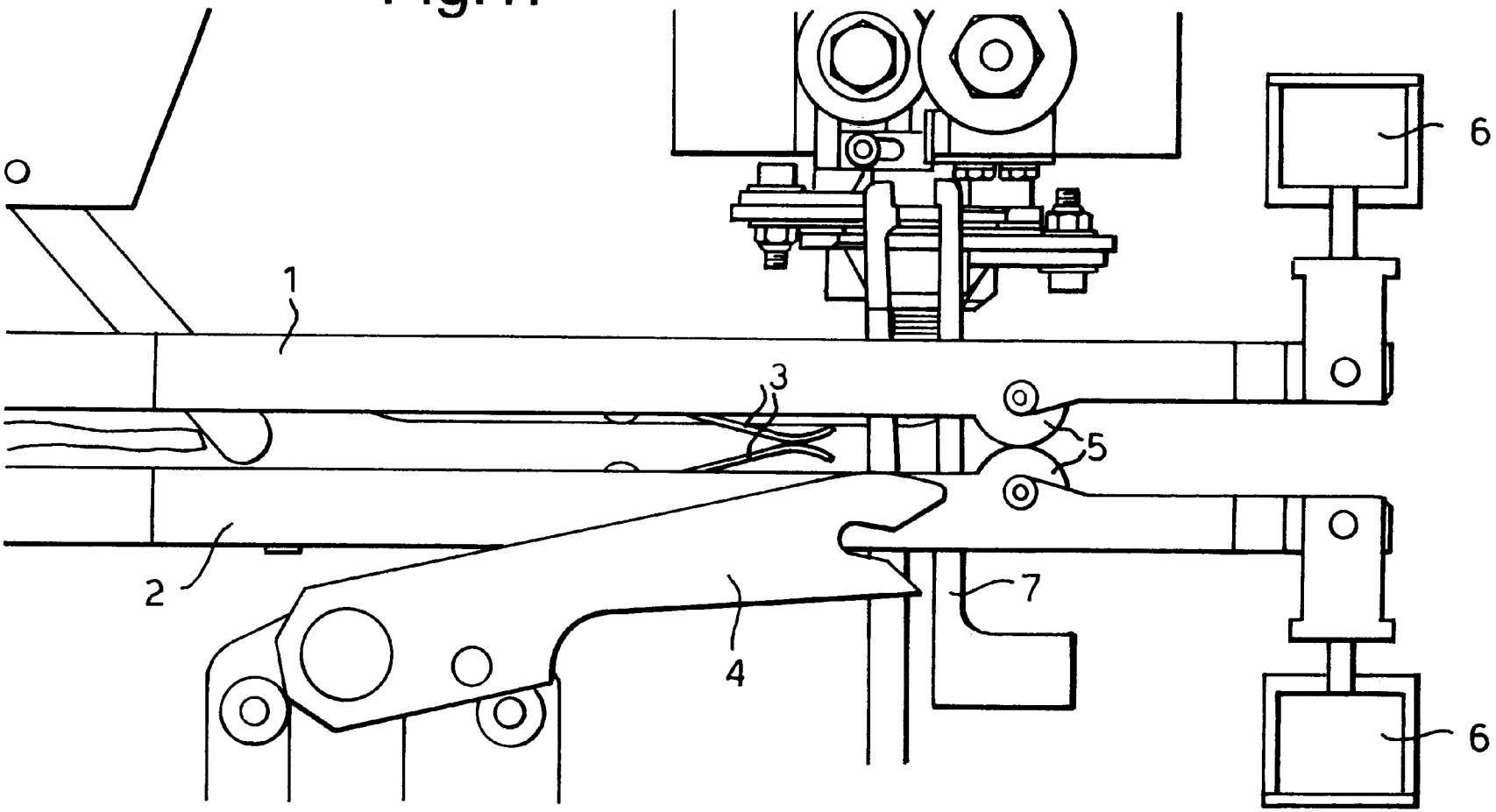
FIG. 1 shows a side view of the sealing portion of a bag sealing machine; and, FIGS. 2*a* and 2*b* show an example of a pneumatic arrangement for applying pressure to the arms shown in FIG. 1.

As shown in FIG. 1, the bag sealing apparatus according to the present invention includes an upper arm 1 and a lower arm 2. The arms are pivotally mounted to a machine at one end of the arms 1,2 (to the left end of the arm not shown in FIG. 1). Each of the arms have one of a pair of leaf springs 3 which together form the first abutment, and each has a roller 5 which together forms the second abutment. The arms 1,2 are urged towards each other by a pair of pneumatic cylinders 6 so that the leaf springs 3 on the arms 1,2 contact each other, and the rollers 5 on the arms 1,2 also contact each other.

In use, the open neck of a bag to be sealed is urged between the arms 1,2 at the left hand end of the arms 1,2 as shown in FIG. 1. A follow-up member 4 is moved behind the neck of the bag, and is moved in the same direction as the bag is travelling at a speed greater than that of the bag, causing the open neck of the bag to be gathered together. The gathered together neck of the bag is pushed against the pair of leaf springs 3, which bend apart allowing the gathered together neck of the bag to pass through.

A length of adhesive tape (not shown) is grabbed by a gripper 7, and is pulled across the path of the neck of the bag downstream of the leaf springs 3. The gathered together neck of the bag is pushed onto the adhesive side of the length of adhesive tape by the follow-up member 4, and into contact with the opposed rollers 5. As the gathered together neck of the bag is pushed against the rollers 5, the arms 1,2 separate as the force on the rollers 5 exceeds the force applied to the arms 1,2 by the pneumatic cylinders 6. This allows the gathered together neck of the bag to pass between the rollers 5 which wraps the adhesive tape around the neck of the bag, and sticks the adhesive tape tie onto itself, thereby sealing the bag.

Figure 2A:
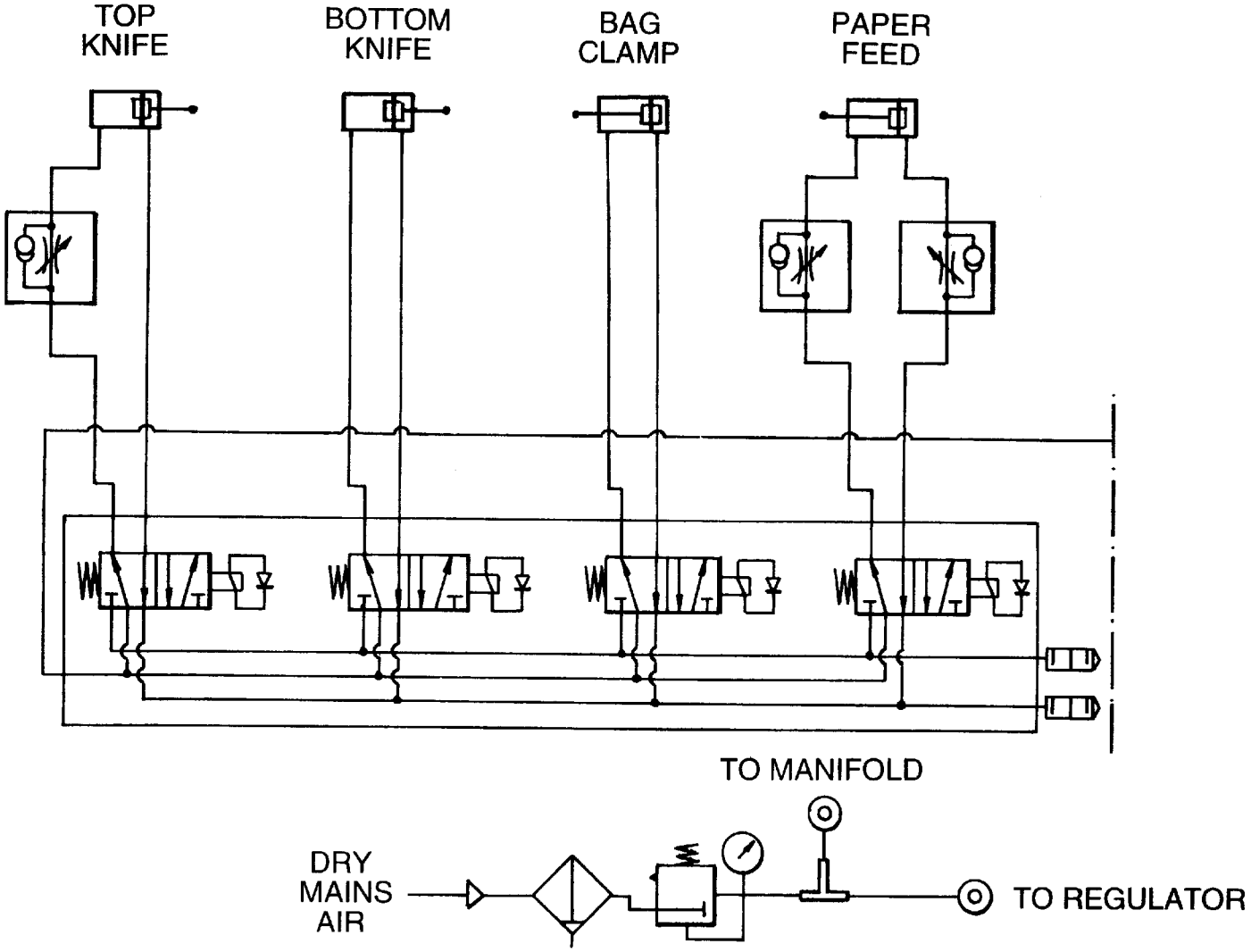
Figure 2B:
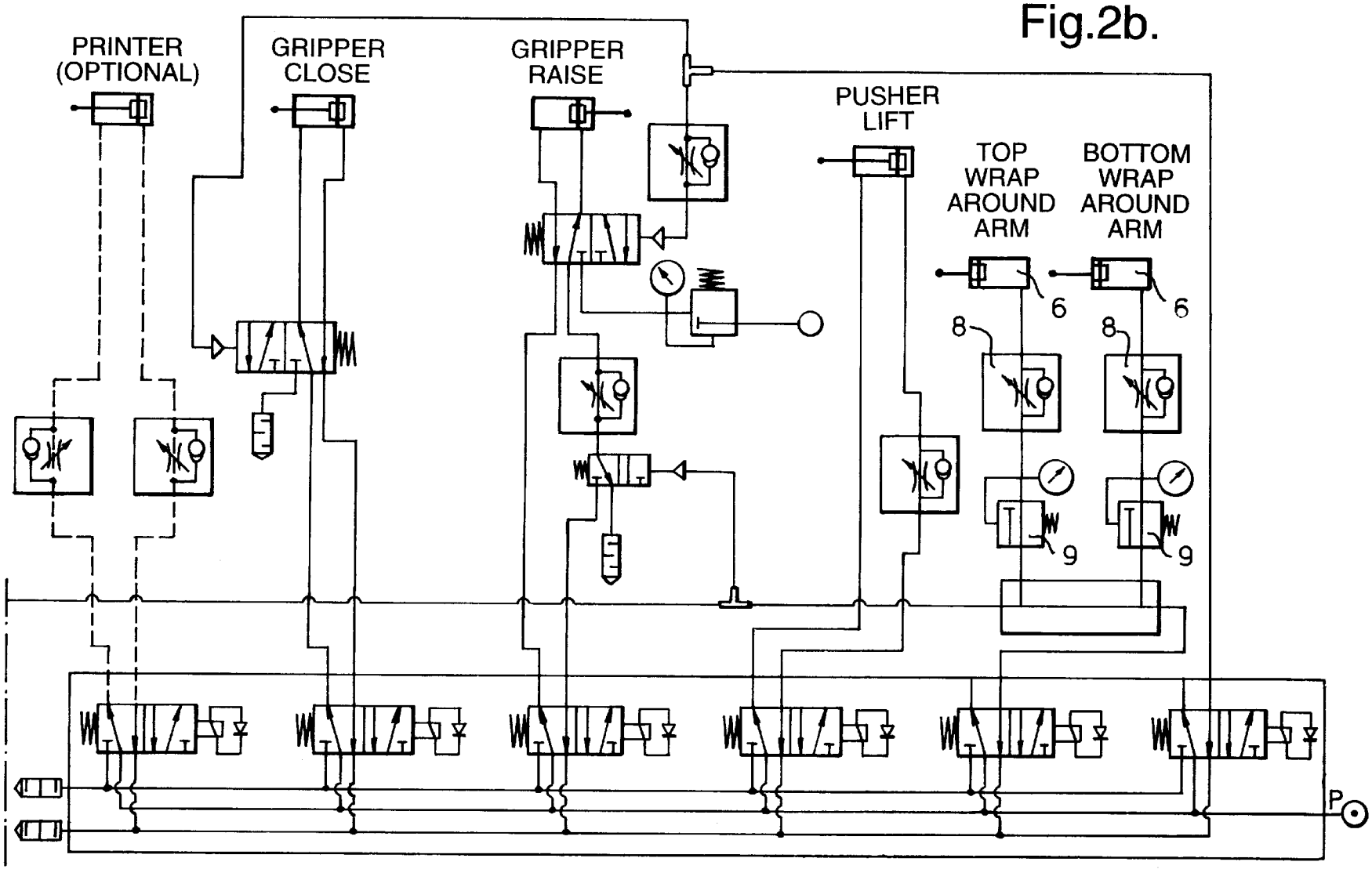

The pneumatic cylinders 6 are supplied with air from the general pneumatic system of the machine, which, as shown in FIG. 2, also controls the cutting of the adhesive tape, gripping of the tape etc. The air supply to the pneumatic cylinders 6 is controlled by a variable pressure controller 9 associated with each of the pneumatic cylinders 6. This allows the pressure applied by each of the pneumatic cylinders 6 to the arms 1,2 to be controlled. The variable pressure controllers 9 are located remotely from the pneumatic cylinders 6 in a position which makes them easily accessible during operation of the machine, and therefore allows the pressure to be changed during operation. The pressure applied to the arms 1,2 is varied depending on a number of factors, for example one or more of the speed at which the bag passes through the arms 1,2, the material from which the bags are made, the gauge of the material of the bags and the weight of the contents of the bags. The variable pressure controllers 9 may be controlled by a controller (not shown) so that the pressure applied by the pneumatic cylinders 6 is preset depending on the type and content of the bag.

A one-way flow restrictor 8 is also provided immediately upstream of each of the pneumatic cylinders 6. The flow restrictors 8 are arranged so that air can flow rapidly to the pneumatic cylinders 6, but can only flow out of the cylinder at a low bleed rate.

I claim:

1. A bag sealing machine comprising:

pair of pivoted arms (1,2) between which the open neck of a filled bag to be sealed is introduced, said pivot arms having upstream and downstream ends;

a first abutment (3) comprising a pair of leaf springs and provided on the arms, the open neck being gathered together against the leaf springs;

a second abutment (5) provided on the arms for wrapping an adhesive tape around the gathered together open neck, said adhesive tape being extended across the pivoted arms (1,2) for wrapping around the open neck; and pneumatic cylinders (6) connected to the downstream ends of the pivoted arms (1,2), said pneumatic cylinders (6) being arranged to urge the pivoted arms (1,2) together.

2. A bag sealing machine according to claim 1, further comprising a variable pressure controller (9) located remotely from the pneumatic cylinders (6) to enable the air pressure applied to the pneumatic cylinders (6) to be varied.

3. A bag sealing machine according to claim 2, in which the variable pressure controller (9) is arranged to be accessible during the operation of the machine to enable the pressure applied to the pneumatic cylinders (6) to be varied during operation of the machine.

4. A bag sealing machine according to claim 2, in which separate variable pressure controls (9) are provided for each of the pneumatic cylinders (6).

5. A bag sealing machine according to claim 1, in which each of the pneumatic cylinders (6) has connected to it a one way flow restrictor (8) arranged so that air can readily flow into a respective cylinder (6) but can only flow out of a respective cylinder (6) at a low bleed rate.

6. A bag sealing machine according to claim 4, which further comprises a selector switch to select between a number of different pressure controls to apply one of a number of predetermined pressures to the pneumatic cylinders (6).

7. A bag sealing machine according to claim 1 in which the second abutment (5) is formed by a pair of rollers mounted on the pivoted arms (1,2).

* * * * *